US007396007B2

(12) United States Patent
Sommerer et al.

(10) Patent No.: US 7,396,007 B2
(45) Date of Patent: Jul. 8, 2008

(54) POSITIONING DEVICE FOR A ROTATIONALLY DISPLACEABLE POSITIONING ELEMENT

(75) Inventors: Frank Sommerer, Leipzig (DE); Jörg Werner, Oschatz (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 278 days.

(21) Appl. No.: 11/091,228

(22) Filed: Mar. 28, 2005

(65) Prior Publication Data

US 2005/0281636 A1 Dec. 22, 2005

(30) Foreign Application Priority Data

Mar. 30, 2004 (DE) ..... 10 2004 015 593

(51) Int. Cl.
*B65H 5/22* (2006.01)

(52) U.S. Cl. ..... 270/52.22; 270/52.23; 270/52.24; 270/52.25; 270/52.26; 270/52.28; 198/803.5; 74/89.23

(58) Field of Classification Search ..... 270/52.22, 270/52.23, 52.24, 52.25, 52.26, 52.28; 198/803.5, 198/803.7, 867.03; 74/89.23
See application file for complete search history.

(56) References Cited

U.S. PATENT DOCUMENTS 2,149,462 A * 3/1939 Oppliger ..... 270/52.24
2,163,732 A * 6/1939 Kleineberg et al. ..... 270/52.27
3,677,108 A * 7/1972 Prikryl et al. ..... 74/625
3,877,677 A * 4/1975 Daghe et al. ..... 251/228
6,357,479 B1 3/2002 Wagner et al.
2002/0082568 A1 * 6/2002 Yam ..... 604/319

FOREIGN PATENT DOCUMENTS

| | | | |
|---|---|---|---|
| DE | 1 208 964 | B | 1/1966 |
| DE | 21 35 081 | C | 3/1972 |
| DE | 80 05 419 | U1 | 7/1980 |
| DE | 199 50 672 | A1 | 4/2001 |
| EP | 1 008 541 | A1 | 6/2000 |

OTHER PUBLICATIONS

Full English translation of DE 12 08 964, Jan. 13, 1966.
Partial English translation of DE 80 05 419, Jul. 3, 1980.

* cited by examiner

*Primary Examiner*—Gene O. Crawford
*Assistant Examiner*—Leslie A Nicholson, III
(74) *Attorney, Agent, or Firm*—Keating & Bennett, LLP

(57) ABSTRACT

A positioning device for a positioning element, which is rotationally displaceable about a first axis, including a positioning member engaged with the positioning element. The positioning member is rotatable about a second axis perpendicular to and spaced from the first axis. The positioning device further includes a slotted link disposed on the positioning element and arranged radially about the first axis, a threaded spindle rotatable about a fixed point, and a link block inserted into the slotted link it cannot be turned. The link block is defined by a spindle nut engaged with the threaded spindle. The thread pitch of the threaded spindle corresponds to a predefined range of the positioning angle of the positioning element such that the positioning element is displaceable within the range of the positioning angle by two rotations of the threaded spindle or less.

8 Claims, 5 Drawing Sheets

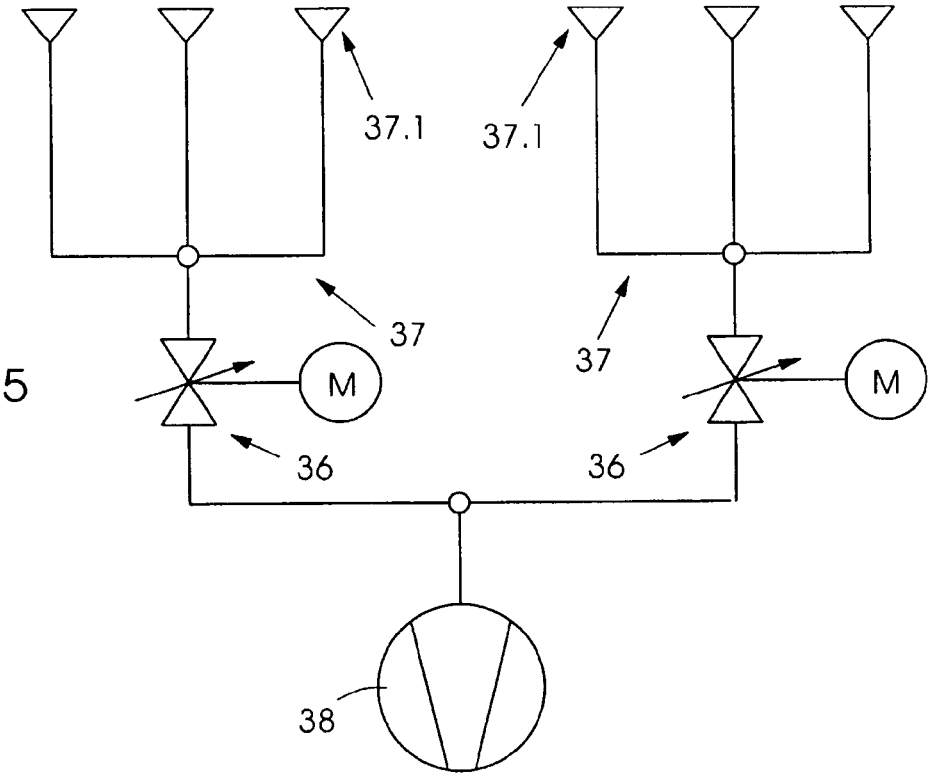
Fig.5
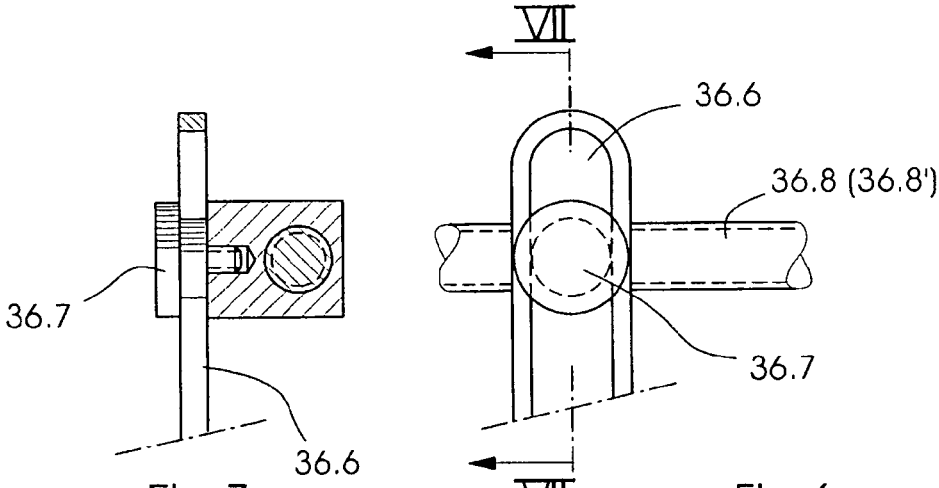
Fig.7
Fig.6

POSITIONING DEVICE FOR A ROTATIONALLY DISPLACEABLE POSITIONING ELEMENT

BACKGROUND OF THE INVENTION

1. Field of the Invention

The present invention relates to a positioning device for a positioning element, which is rotationally displaceable with respect to a first axis, and which includes a positioning member which engages with the positioning element, the positioning member being rotatable about a second axis that is perpendicular to and spaced from the first axis.

2. Description of the Related Art

Positioning devices of this type are provided in signature feeders with the model designation P311, which are components of saddle stitchers marketed by Heidelberg Web Systems Inc., Durham, USA under the name Pacesetter 1000. These positioning devices include a sprocket provided on the positioning element with which a worm gear meshes. The positioning element is provided with a valve including a control disc having a hole pattern, which, under normal operating conditions, periodically produces a fluid connection between a suction device and a vacuum generator. The suction device functions in the signature feeder to open the signatures which are then transferred along a saddle chain of the saddle stitcher. The suction device includes suction boxes which are in fluid connection with the vacuum generator during a periodically recurring time window and applies suction to a respective arm of a respective signature feeder within this time window.

Opener drums are disposed parallel to the axis of the suction device, and each of the suction boxes for a respective one of the signature arms is disposed thereon. For dispensing the signatures to the saddle chain, the suction boxes are aerated after the time window has expired such that the signatures separate from the suction boxes. The timing of the separation of the signatures from the suction boxes must be adaptable to the processing speed and to the material properties of the signatures. Accordingly, the control disc is rotationally displaceable.

A transfer drum precedes the gripper drum. The transfer drum transfers signatures taken from a signature stack using the separating device and releases the signatures to the opener drum.

The signature feeders include an operating side on which operating elements are disposed. The operating elements include a rotary knob for turning the worm gear which, via turning of the sprocket meshing therewith, rotationally displaces the control disc, and thus, the time window and the timing at which the signatures separate from the suction boxes is changed.

In some instances, the required displacement of the control disc requires that the worm gear must execute a plurality of revolutions. This makes it more difficult to a reproducibly set the timing at which the signatures separate from the suction boxes.

SUMMARY OF THE INVENTION

To overcome the problems described above, preferred embodiments of the present invention provide a positioning device in which the displacement of the positioning element is easily reproducible.

A positioning device according to a preferred embodiment includes a slotted link that is arranged radially about a first axis and disposed on the positioning element, a threaded spindle that is rotatable about a fixed point, and a link block that is inserted into the slotted link such that it cannot be turned. The link block is preferably a spindle nut which operates together with the threaded spindle.

Preferably, the positioning element is displaced within a predefined range of the position angle by two revolutions of the threaded spindle or less. Thus, a large positioning travel is achieved by a threaded spindle having only two windings. The windings are spaced apart from one another to achieve this large positioning travel.

Other features, elements, steps, characteristics and advantages of the present invention will become more apparent from the following detailed description of preferred embodiments with reference to the attached drawings.

BRIEF DESCRIPTION OF THE DRAWINGS

FIG. 5 is an installation plan including the valves and suction boxes which are controlled by the valves.

FIG. 6 is a detailed view of a valve and a positioning element engaged therewith.

FIG. 7 is a section view along the line VII in FIG. 6.

DETAILED DESCRIPTION OF PREFERRED EMBODIMENTS

Since a preferred use of the positioning device according to preferred embodiments of the present invention is in a machine for post-printing processing, such as, for example, a saddle stitcher including a signature feeder, to control suction boxes for opening of signatures having at least one fold, the positioning device is described with reference to a saddle stitcher.

Figure 1:
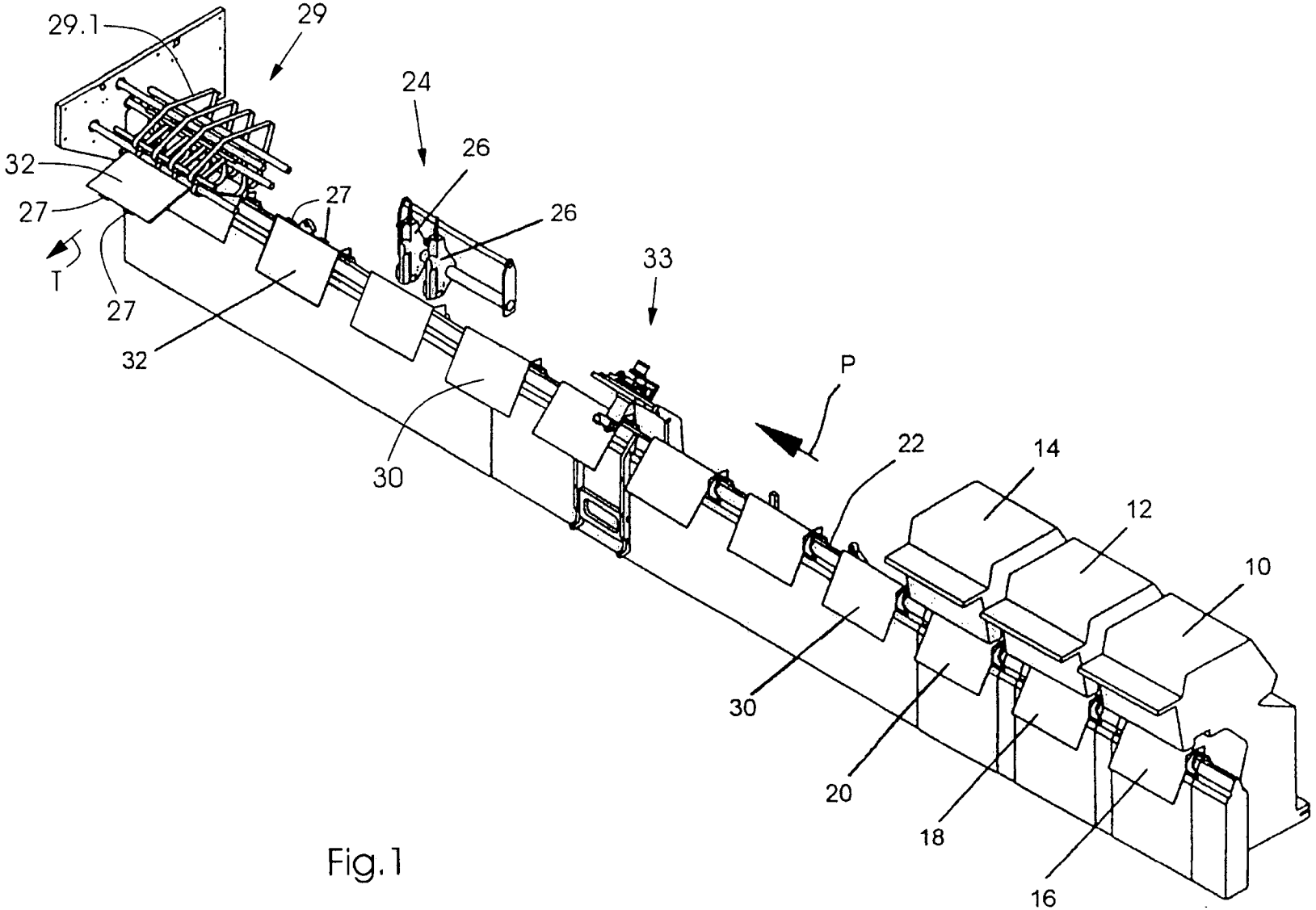
FIG. 1 is a perspective view of a saddle stitcher including signature feeders.

The preferred embodiment of the saddle stitcher shown in FIG. 1 includes three signature feeders 10 12, 14, each of which deposits one signature 16, 18, 20 along a saddle chain. The arrangement of the saddle chain is not shown in detail. The signatures 16, 18, 20 are deposited on the saddle chain one over another so as to form copies 30 to be stitched. The copies 30 are transported in a direction of movement of the saddle chain, indicated by arrow P, along a transport and stitching line 22 which extends along the signature feeders 10, 12, 14 and beyond the stitching station 24 to a transfer station 29. The stitching station 24 preferably includes, for example, two stitching heads 26 and one bender (not shown) associated with a respective stitching head. The bender bends the arm of staples 27 punched into the copies 30 by the stitching heads 26.

The transfer station 29 also preferably includes a boom conveyor 29.1 and an ejector blade (not shown). The ejector blade engages a respective fold of the stitched copy 32, lifts it from the transport and stitching line 22, and transfers it to the boom conveyor 29.1. The stitched copies 32 are further transported in the direction of the arrow T by the boom conveyor 29.1 to, for example, a cutting device.

Upstream from the stitching station 24, with respect to the direction of transport P, a measurement station 33 is provided in which the thickness of the copies 30 to be stitched is determined.

Figure 2:
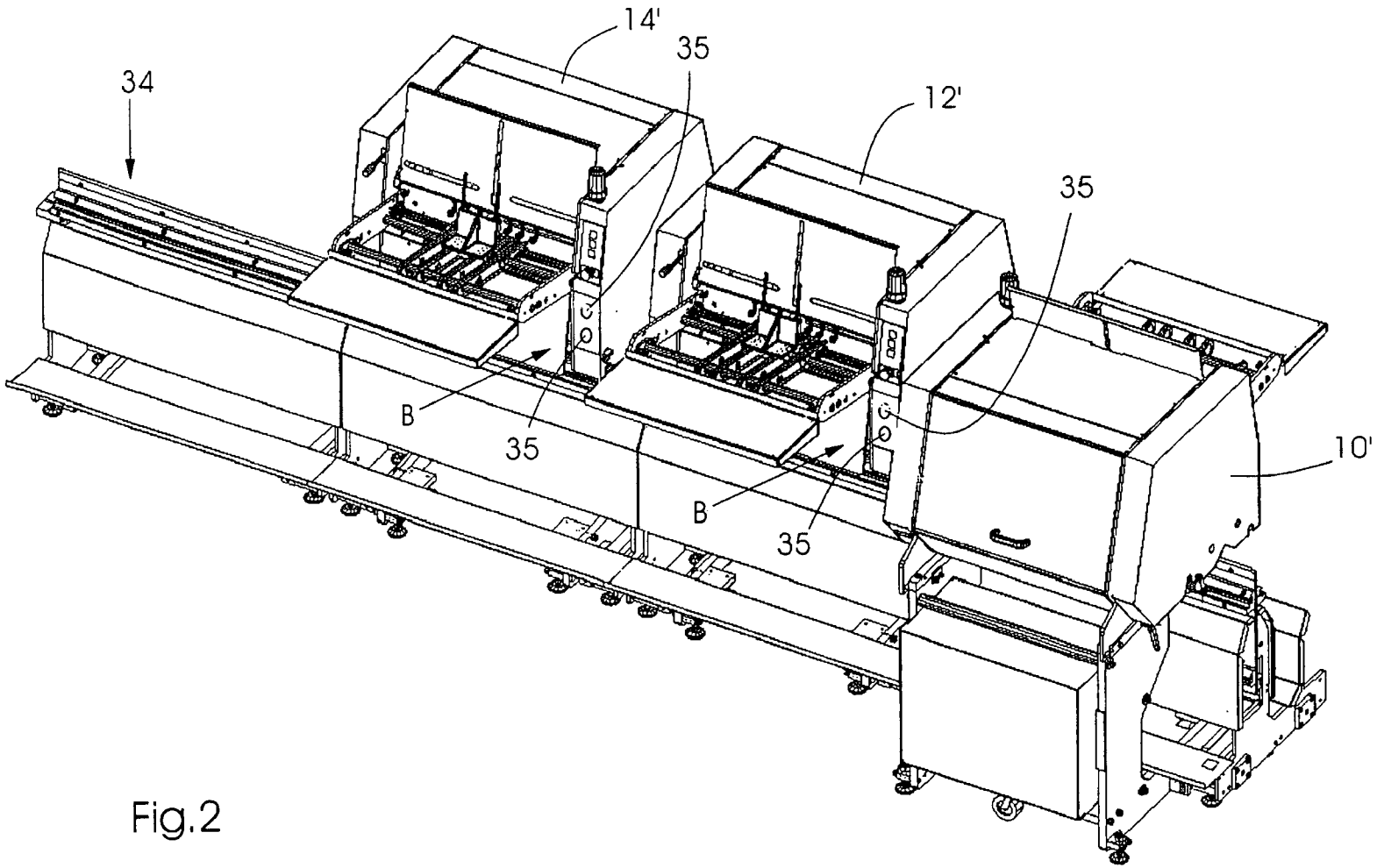
FIG. 2 is a perspective view of a section of a saddle stitcher on which the signature feeders are disposed showing operating elements disposed on an operating side.

FIG. 2 shows a portion of a saddle stitcher including signature feeders 10', 12', 14', a saddle chain arrangement 34, and operating elements disposed on an operating side B of the signature feeders 10', 12', 14' and including rotary knobs 35, which will be described in more detail below. As shown in FIG. 2, the operating side can be provided on either side of the saddle chain arrangement 34. In this preferred embodiment, the operating elements including the rotary knobs 35 of the signature feeders 12' and 14' are accessible from the one side of the saddle chain arrangement 34, while the operating elements of the signature feeder 10' are accessible from the other side of the saddle chain arrangement 34.

The signature feeders 10', 12', 14' include valves 36 which operate in a similar manner to those of the previously described known saddle stitcher. Particularly, the valves 36 control suction boxes (not shown) which function in a manner similar to those of the previously described known saddle stitcher.

Figure 3:
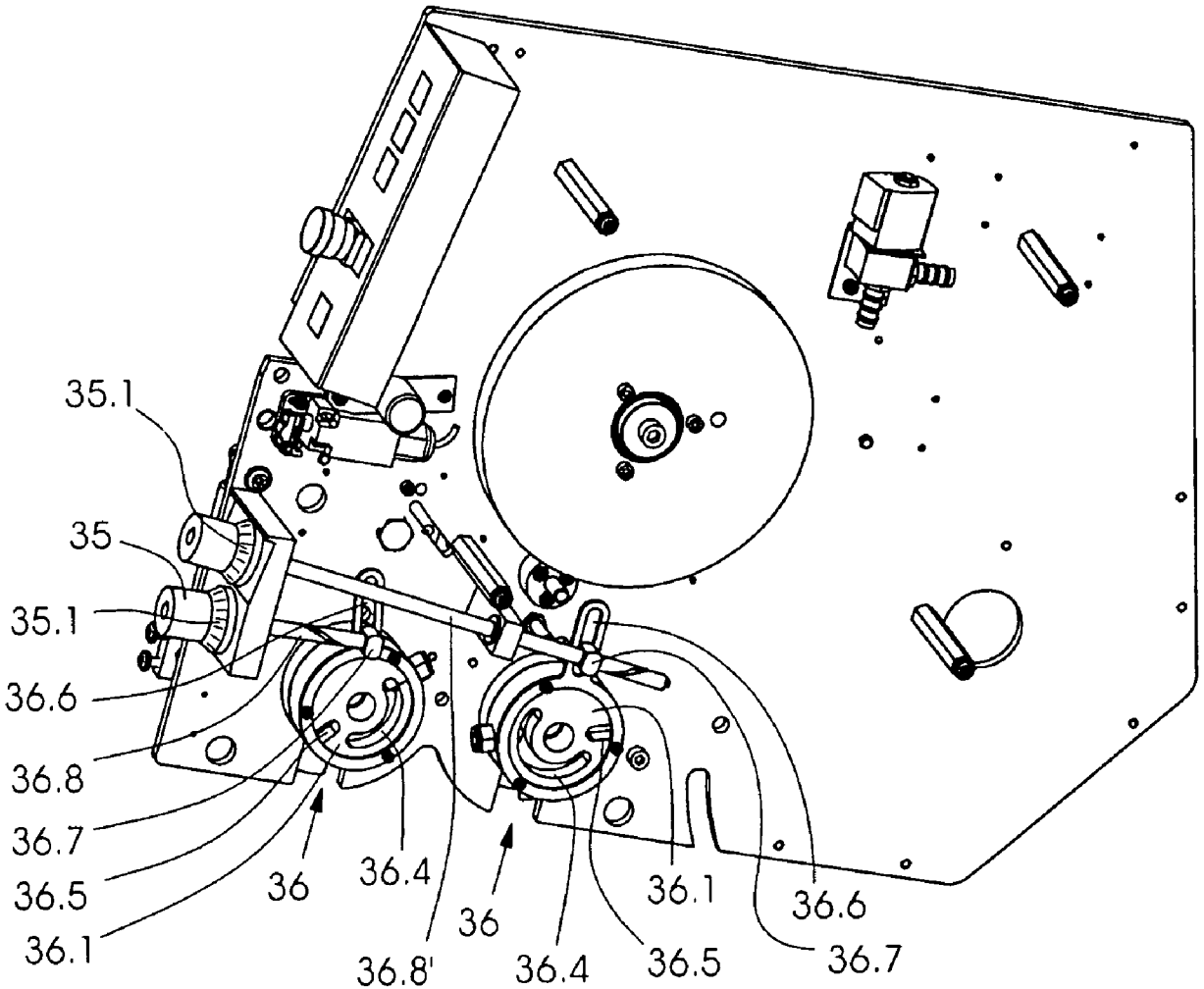
FIG. 3 is a perspective view showing a component including valves of a signature feeder similar to that of FIG. 2, in which the valves are shown in a partially disassembled state.

FIG. 3 shows elements of the signature feeders 10', 12', 14' including the valves 36. The valves 36 are shown in a partially disassembled state, such that a positioning element 36.1 disposed in the interior of each valve 36 can be seen. The positioning element 36.1 defines a control disc provided with a hole pattern. The control disc is rotationally displaceable with respect to a first axis.

In the partially disassembled state shown in FIG. 3, the respective valve 36 is missing. In particular, a shaft disposed in the center of the positioning element 36.1, which rotates in synch with the signatures 16, 18, 20 being removed from the signature stacks is not shown. The longitudinal axis of this shaft defines a first axis 36.2, with respect to which the positioning element 36.1 defined by a control disc is rotationally displaceable.

Figure 4:
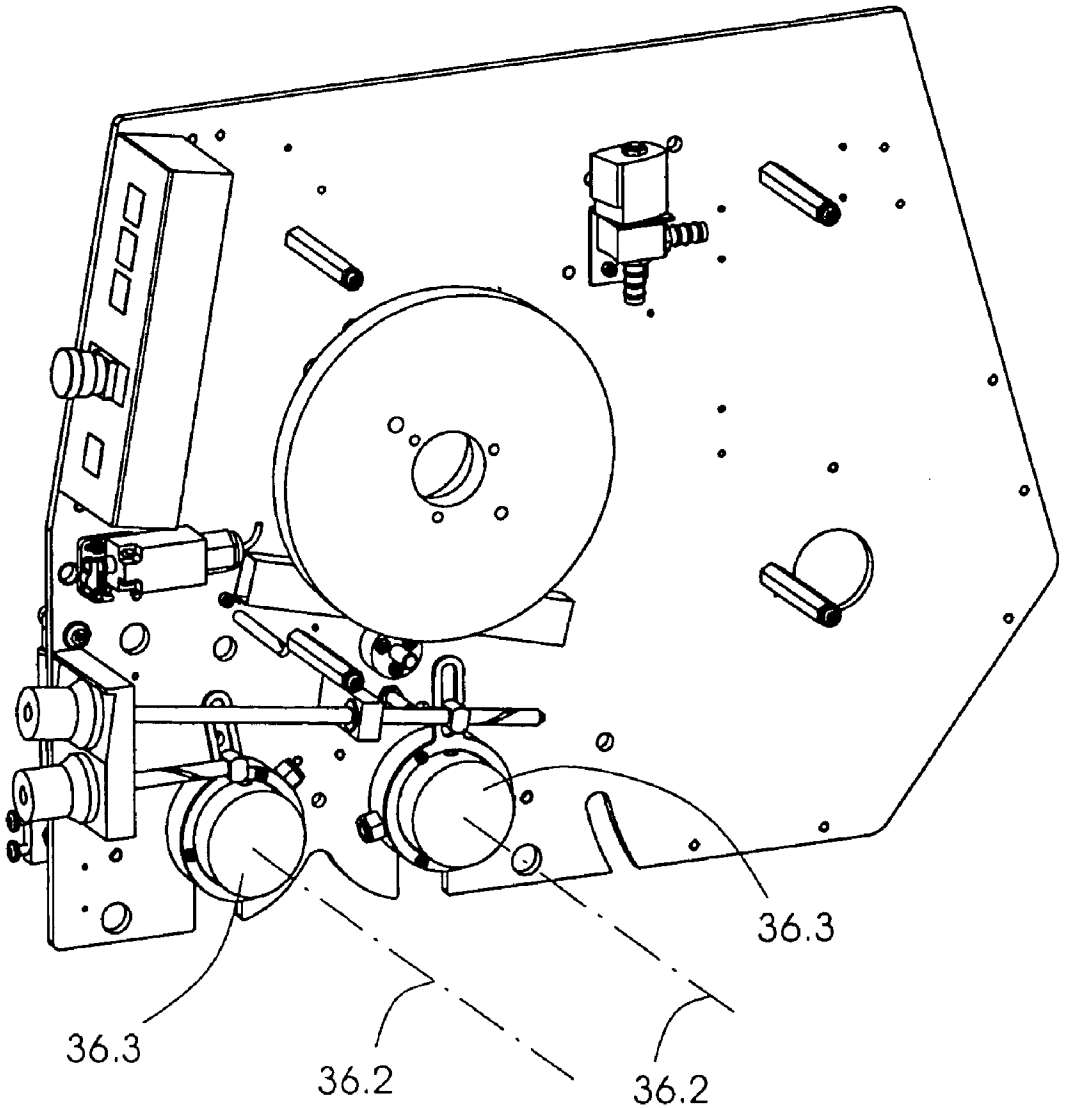
FIG. 4 is a perspective view of the component shown FIG. 3, in which the valves are shown in an assembled state.

The shaft defines a cavity and includes a valve cap 36.3 (see FIG. 4) disposed on the end of the shaft that faces the observer of FIG. 3 and that rotates with the shaft under normal operating conditions. A hole is provided in the valve cap 36.3 and is aligned with the cavity of the shaft. The hole moves, during rotation of the shaft under normal operating conditions, along a hole pattern of the positioning element 36.1. The hole pattern includes an elongated hole 36.4 that is concentric with the shaft and a through hole 36.5 which moves in the direction of rotation of the valve caps 36.3 following the elongated hole 36.4. The two valve caps 36.3 which are shown in FIG. 4 rotate under normal operating conditions in opposite directions such that the hole provided in the respective valve cap 36.3 first passes the elongated hole 36.4 and subsequently the through hole 36.5. In so doing, the respective elongated hole 36.4 is connected to a vacuum generator (not shown) and the respective through hole 36.5 is connected to the atmosphere.

The suction boxes for opening the signatures 16, 18, 20 are in fluid communication with a respective cavity of the shaft having the respective valve cap 36.3 disposed at the end thereof.

The pressurization of the suction boxes with vacuum and a subsequent aeration of the same are controlled by the positioning element 36.1.

According to the installation plan represented in FIG. 5, when two suction devices 37 are provided, of which a respective one includes a plurality of suction devices 37.1. One of the suction devices 37 is disposed at a respective one of the opener drums described above, which, under normal operating conditions, preferably rotates about the first axis 36.2 (see FIG. 4).

Under normal operating conditions, due to the rotation of the valve caps 36.1, a respective one of the valves 36 periodically produces a fluid connection between one of the suction devices 37 and a vacuum generator 38.

The rotational displaceability of the positioning element 36.1 defined by the control discs of the valves 36 is indicated in each case in FIG. 5 by an arrow at the valve 36. To drive the shafts carrying the valve caps 36.3, a motor M, for example, is provided. Driving can, however, also be performed by a common drive unit for the opener drums, with the transfer drum preceding the opener drum, and the separating device.

For the rotational displacement of a respective positioning element 36.1 with respect to the first axis 36.2, a slotted link 36.6 arranged radially with respect to the first axis 36.2 is disposed thereon. A link block 36.7 preferably defined by a spindle nut is inserted in the slotted link 36.6 such that it cannot be turned, and a threaded spindle 36.8 or 36.8' that is rotatable about a fixed point is engages with the respective spindle nut.

The respective threaded spindle 36.8 or 36.8' defines a positioning member engaged with the positioning element 36.1. The positioning member is rotatable about a second axis that is substantially perpendicular to and spaced from the first axis 36.2, namely the longitudinal axis of the threaded spindle 36.8 or 36.8'.

To further facilitate the reproducibility of settings of the positioning element 36.1, the positioning element 36.1 is displaceable within a predefined range of the positioning angle by two rotations of the threaded spindle 36.8 or 36.8' or less. This is achieved by the correlation of the thread pitch of the threaded spindle 36.8 or 36.8' to the range of the positioning angle.

The threaded spindles 36.8, 36.8' are each connected to a rotary knob 35 and actuated thereby. Preferably, the rotary knob 35 is lockable and includes a scale 35.1 on which rotational positions of the threaded spindle 36.8 or 36.8' are marked. The scale can be one of the following types of scales: a division scale, a numerical scale, a scale for directional tendencies, a +/− scale or a notched scale. Rotary knobs of this type are commercially available and can, for example, be acquired under the model designation GN from Otto Ganter GmbH and Co. KG in Furtwangen, Germany.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A positioning device comprising:

a positioning element that is rotationally displaceable about a first axis;

a positioning member engaging with the positioning element, said positioning member being rotatable about a second axis that is substantially perpendicular to and spaced from the first axis;

a slotted link disposed on the positioning element and arranged radially about the first axis; and a link block inserted into the slotted link such that the link block cannot be turned; wherein the positioning member is defined by a threaded spindle rotatable about a fixed point;

a thread pitch of the threaded spindle corresponds to a predefined range of the positioning angle of the positioning element such that the positioning element is displaceable within the range of the positioning angle by two rotations of the threaded spindle or less;

the positioning element includes a substantially circular shaped portion and the slotted link extends outward from the substantially circular shaped portion;

the positioning element includes an elongated hole and a through hole provided in the substantially circular shaped portion, the elongated hole being concentric with the first axis; and the elongated hole and the through hole are arranged to periodically provide a fluid connection between a suction device and a vacuum generator.

2. The positioning device according to claim 1, wherein the link block includes a spindle nut engaged with the threaded spindle.

3. The positioning device according to claim 1, further comprising a lockable rotary knob connected to an end of the threaded spindle.

4. The positioning device according to claim 3, wherein the lockable rotary knob includes a scale provided thereon, the scale includes markings for rotational positions of the threaded spindle.

5. The positioning device according to claim 1, wherein the positioning element is a control disc of a valve.

6. The positioning device according to claim 5, wherein, under normal operating conditions, the valve periodically produces a fluid connection between the suction device and the vacuum generator.

7. A post-printing processing machine comprising:

a positioning device according to claim 1 for controlling suction boxes.

8. A saddle-stitcher for signatures comprising:

a saddle chain arrangement;

a plurality of signature feeders disposed along the saddle chain arrangement; and a positioning device according to claim 1 for controlling suction boxes of each of said plurality of signature feeders.

* * * * *